United States Patent [19]

Bertrand et al.

[11] 4,444,606

[45] Apr. 24, 1984

[54] PROCESS FOR THE MANUFACTURE OF FINE PROPELLANT POWDERS BY GRANULATION, AND POWDERS THUS OBTAINED

[75] Inventors: Yves Bertrand, Versailles; Remy Favrot, Pont de Buis; Pierre Gaudilliere, Livry Gargan; Jean-Charles Perennou, Le Relecq Kerhuon; Bernard Wiedemann, Angouleme, all of France

[73] Assignee: Societe Nationale des Poudres et Explosifs, Paris, France

[21] Appl. No.: 321,096

[22] Filed: Nov. 13, 1981

[30] Foreign Application Priority Data

Nov. 14, 1980 [FR] France ..... 80 24187

[51] Int. Cl.[3] ..... C06B 45/00

[52] U.S. Cl. ..... 149/2; 107/297; 107/292; 149/96; 149/118; 264/3 C

[58] Field of Search ..... 102/292; 149/96, 2, 149/118; 264/3 C

[56] References Cited

U.S. PATENT DOCUMENTS

| | | | |
|---|---|---|---|
| 1,752,881 | 4/1930 | Borland | 264/3 D |
| 3,236,702 | 2/1966 | Sapiego | 149/96 X |
| 3,325,571 | 6/1967 | Sapiego | 149/96 X |
| 3,329,743 | 7/1967 | Coffee | 149/96 X |
| 3,563,977 | 2/1971 | Cucinotta | 264/3 D X |
| 3,671,342 | 6/1972 | Slawinski | 149/118 X |
| 3,711,343 | 1/1973 | Dunigan et al. | 149/118 X |

FOREIGN PATENT DOCUMENTS 619 of 1882 United Kingdom .

OTHER PUBLICATIONS

Davis, The Chemistry of Powder and Explosives, 1943, John Wiley & Sons, New York, pp. 287 to 292.

Urbanski, Chemistry and Technology of Explosives, vol. III, Pergamon Press, New York, 1967, pp. 640 and 641.

*Primary Examiner*—Leland A. Sebastian

*Attorney, Agent, or Firm*—Bucknam and Archer

[57] ABSTRACT

The present invention relates to a process for the manufacture of fine propellant powders by granulation, and, by way of products, to the fine powders thus obtained.

The process according to the invention consists in granulating the base materials, wetted with solvent, in a granulating tray 11, in subsequently subjecting the granules thus obtained to a first partial drying in a drier 14, and in completing the finishing of the said granules in a rounder 16, optionally in the presence of solvent.

The process according to the invention can be carried out continuously or batchwise, with a very high degree of operational safety. The propellant powders thus obtained possess a good activity and are suitable for small-caliber and medium-caliber weapons.

14 Claims, 2 Drawing Figures

Figure 1:
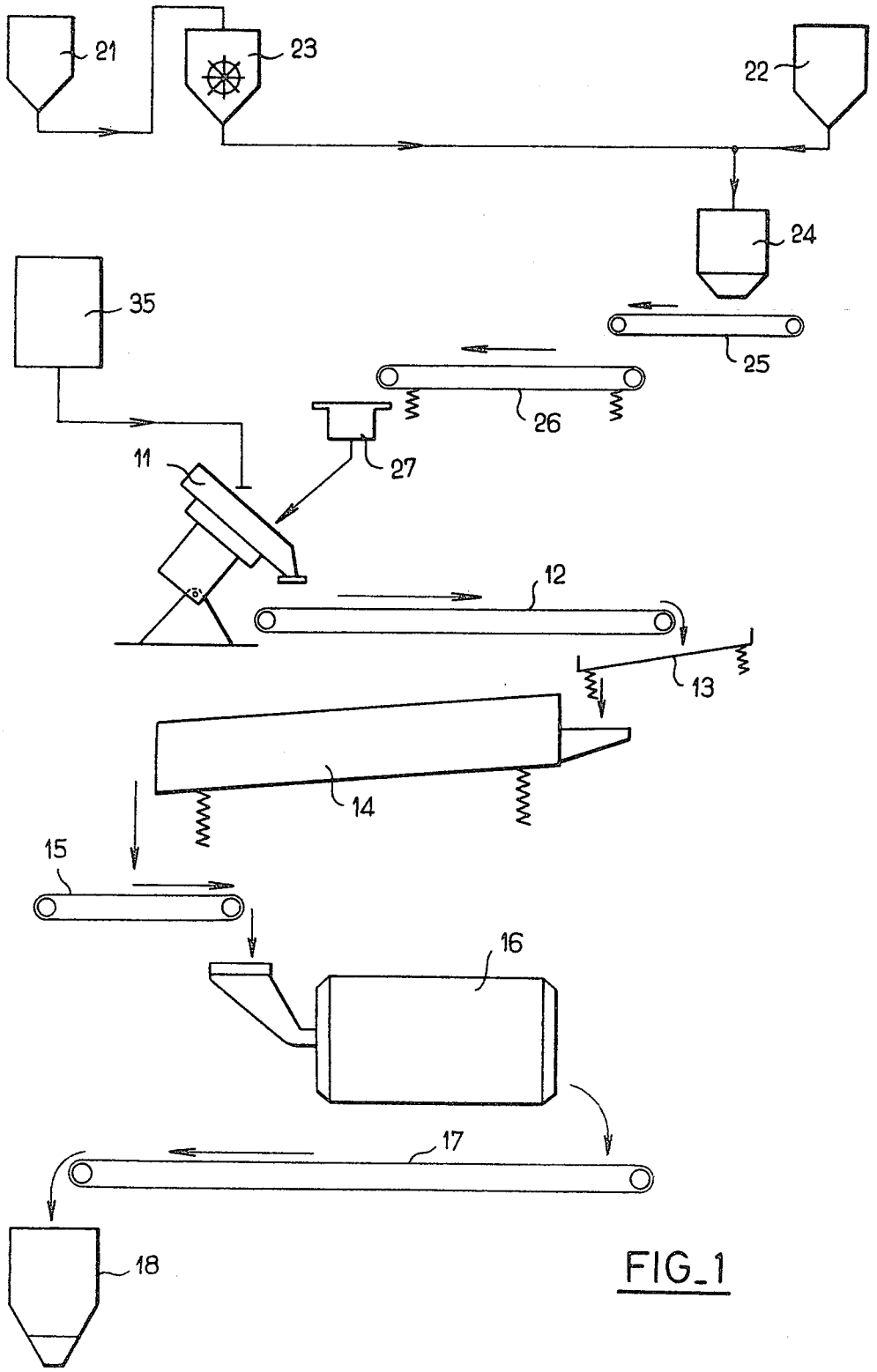

PROCESS FOR THE MANUFACTURE OF FINE PROPELLANT POWDERS BY GRANULATION, AND POWDERS THUS OBTAINED

The present invention relates to the field of propellant granular powders. More precisely, the present invention relates on the one hand to a new process for the manufacture of fine granular powders by granulation of the base energy-producing materials in a granulating tray, and on the other hand, by way of new industrial products, to the fine propellant powders obtained by virtue of this new process.

As a general rule, fine propellant powders for small calibre weapons are nitrocellulose-based powders manufactured in accordance with the so-called "with solvent" process. In this process, the nitrocellulose, optionally mixed with other energy-producing bases, is malaxated with solvents until a homogeneous paste is formed, which is then extruded and chopped into grains, and these are then drained, soaked, dried, glazed and graphitised, if necessary. This process is described thoroughly in the work by Messrs. Louis VENNIN, E. BURLOT and H. LECORCHE entitled "Les Poudres et Explosifs" ("Powders and Explosives"), published in 1932 by the Librairie Polytechnique Ch. BERANGER, pages 578 et seq. This process leads to very good powders but is involved and expensive because it uses an extruder and chopping machines and requires high investment for safety reasons. Furthermore, passing the paste through an extruder constitutes a "bottleneck" in the process, which limits the possibilities in terms of the throughput.

If it is desired to manufacture a porous powder by this process, it is appropriate to introduce large amounts of soluble salt, such as, for example, potassium nitrate, into the paste during malaxation, which salt will be removed at the soaking stage, and this has the disadvantage of producing, as a by-product, large amounts of salt water, which are a source of pollution. Now, it so happens that porous powders are more active than non-porous powders, and that, for many applications, porous powders are sought despite the additional disadvantage exhibited by their manufacture. The activity of a powder characterises both its combustion rate and the amount of gas evolved in a given combustion time.

Those skilled in the art are therefore seeking a process for the manufacture of propellant powders which is relatively simple, which, if possible, does not possess excessive limitations in terms of throughput, and which makes it possible to obtain powders of correct activity without exhibiting the disadvantages inherent in the conventional processes for the manufacture of porous powders.

Various researches have already been carried out in an attempt to dispense with the extruder and the chopping machine. These researches resulted essentially in the process for the manufacture of the so-called "spherical" powders. In this process, a collodion of nitrocellulose is manufactured, which is dispersed in water, the aqueous dispersion is heated so as to cause the solvent to evaporate off, and grains of gelatinised nitrocellulose are recovered. This process is described, for example, in French Pat. Nos. 1,268,986, 1,213,125, 1,195,187, 1,177,887 and 1,168,167 or in U.S. Pat. Nos. 3,200,092, 3,235,420, 3,251,823 and 3,563,977.

This process exhibits the advantage of permitting a high production throughput, but exhibits the major disadvantage of consuming a large amount of energy because it necessitates heating large amounts of water; furthermore, it exhibits disadvantages from the point of view of pollution, because of the large amounts of water, containing gums, which are left as a by-product.

The problem therefore remains of finding a process for the manufacture of fine active propellant powders which is simple and inexpensive, which does not exhibit these disadvantages of pollution and which permits a high throughput, and it has not hitherto been solved in an entirely satisfactory manner.

The object of the present invention is precisely to provide a simple and inexpensive process for the manufacture of fine propellant granular powders having a good activity, for small-calibre weapons.

The process according to the invention consists in granulating the base materials, wetted with solvent, in a rotating apparatus, in carrying out a first partial drying of the granules thus obtained and in completing the finishing of the said granules in a rounder, optionally in the presence of solvent. The process according to the invention can be carried out batchwise or continuously, depending on the needs and the capacities of the available equipment.

The invention also relates, by way of a new industrial product, to the propellant granular powders obtained using the process according to the invention.

Figure 2:
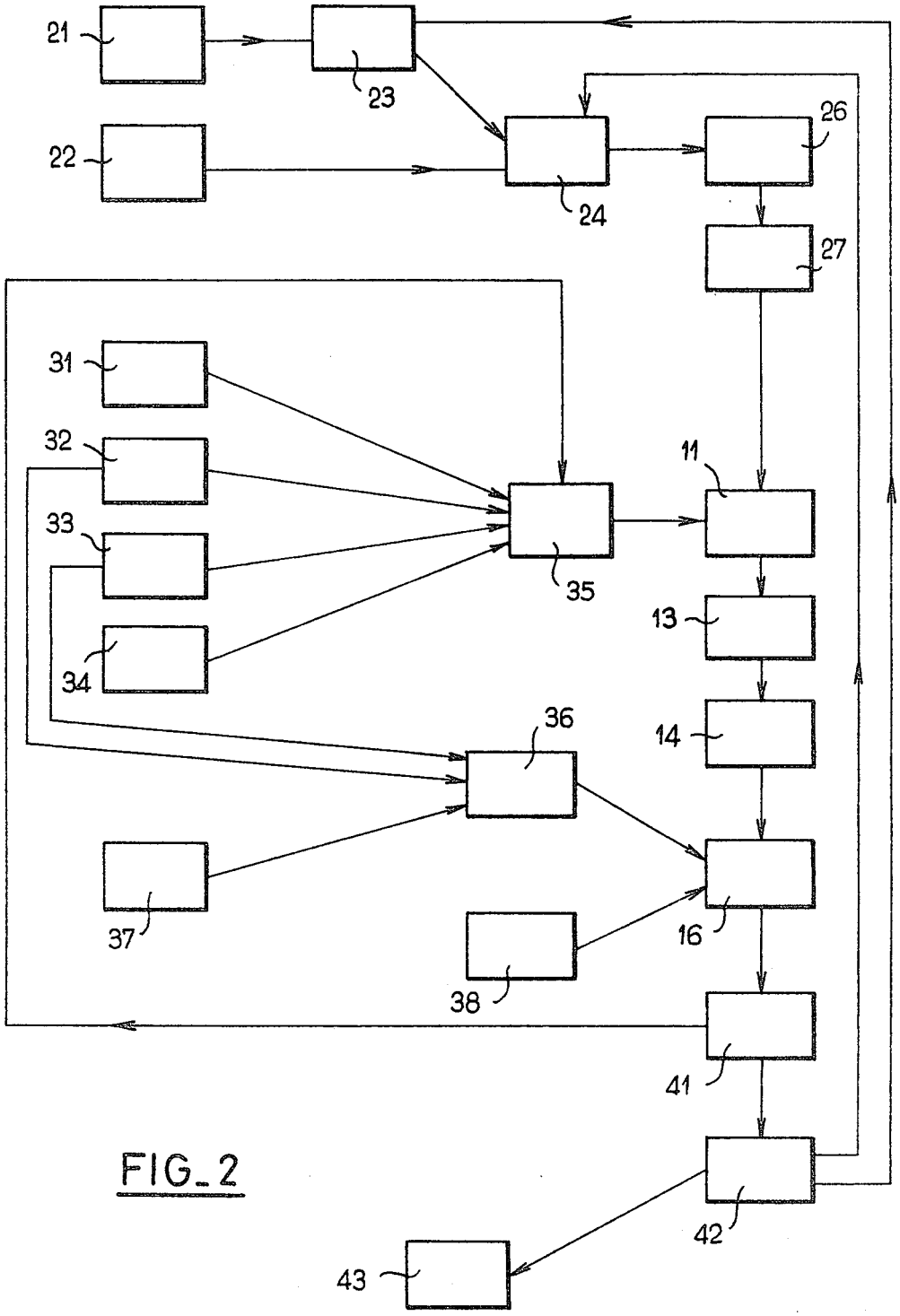

The description which follows gives a detailed illustration of how the invention is carried out, with reference to FIGS. 1 and 2.

FIG. 1 diagrammatically shows the installation required to carry out the process according to the invention continuously.

FIG. 2 is a diagram indicating all the operations required in an example of continuous manufacture according to the invention.

As stated above, the process according to the invention consists initially in granulating the base materials, finely ground and wetted with a solvent, in a rotating apparatus. The finely ground base materials are thus agglomerated with the aid of the solvent, in the form of granules of essentially spherical shape. The rotating apparatus is advantageously a "granulating tray", sometimes also referred to as a "granulating pan", which is widely used in the fertiliser or cement industry, but it is also possible to use any equivalent apparatus. The granulating tray is fed uniformly with base material, and the solvent is sprayed very finely onto the granules during their formation.

The tray empties by the overflowing of the largest granules which are formed therein. The diameter of the granules leaving the tray depends on the starting materials and the grinding thereof, and can be adjusted as follows:

by the residence time of the granules in the tray, which time is a function of both the rotation speed of the tray and its inclination: the closer the plane of rotation of the tray to the vertical, the smaller the granules; it will generally be preferred to have an inclination for which the plane of rotation of the tray forms an angle of about 60° with the horizontal plane; and by the solvent content: the greater the amount of solvent, the larger the granules.

The base materials agglomerated by the process according to the invention consist of the various solid energy-producing bases which can be used in the manufacture of propellant granular powders. Thus, it is possible to use the following bases, by themselves or in a mixture:

nitrocellulose, either derived directly from the nitration of cellulose, or obtained from regenerated powders, recovery powders, whether these be single-base powders or multi-base powders, waste from the manufacture of double-base powders manufactured in accordance with the so-called "solventless" process and also referred to as "S powders", and in particular the machining chips from blocks of S powder, and "press-cake", that is to say the nitrocellulose/nitroglycerine mixture used for the preparation of S powders.

The recovery base materials are very finely ground before use, the average diameter of the ground particles preferably being less than 300 microns for weapons of common calibres. For safety reasons, the grinding, and also the mixing of the ground materials and unground materials, take place under water. The mixture of base materials is then drained to a moisture content of between 10 and 30% and preferably of about 20%, before passing onto the granulating tray.

The agglomeration of the base materials on the granulating tray is carried out with the aid of a solvent. Any solvents for one of the solid bases can be used, but solvents which are insoluble or sparingly soluble in water will be preferred because they are conveniently recovered. Thus, in the case of nitrocellulose, ketones, such as methyl ethyl ketone or methyl isobutyl ketone, esters, such as ethyl acetate, isopropyl acetate or isobutyl acetate, or nitroparaffins, such as nitromethane, will be used as solvents.

The solvent must be finely sprayed above the granules. A stabiliser in solution can be added thereto if it has not been added initially to the base materials, and a plasticising product in solution can optionally be added thereto. According to a preferred embodiment of the invention, a diluent, which must be a non-solvent for the nitrocellulose, but soluble in the solvent used, is added to the solvent. Examples of diluents which may be mentioned are volatile hydrocarbons such as white spirit or petrol A, which is a petrol containing less than 1% of aromatic compounds and at least 80% of linear aliphatic hydrocarbons, and of which the distillation temperature is between 40° and 100° C. The value of the diluent is to permit easier adjustment of the ballistic properties of the granules whilst avoiding excessive gelatinisation.

On leaving the granulating tray, the granules then undergo a first partial drying intended for removing part of the water and part of the solvents, and are then completed in a rounder, optionally in the presence of solvent.

The first drying can be carried out either in a conventional drier, or in equivalent installations such as, for example, a fluidised bed. The granules are then completed in a rounder, the latter operation being absolutely necessary for obtaining a granular propellant powder possessing acceptable properties. The term "rounder" is understood as meaning any rotating apparatus which may or may not be fitted with mixing tools and in which the external surface of the granules is shaped. A granulating tray similar to that used for the actual granulation can advantageously be used as the rounder, but it is also possible to use any other commercial apparatus fulfilling the desired purpose. In the case of a batch process, the granulating tray which was used for the granulation of the base materials can advantageously be used as the rounder.

The treatment in the rounder is advantageously carried out in the presence of solvent and optionally of diluent. The pass through the rounder can advantageously be utilised for adding the constituents which can be fixed to the surface of the grains, such as, for example, combustion moderators or antistatic agents such as graphite.

The total wetting level in respect of solvent, excluding diluent, between the granulating tray and the rounder is generally between 60 and 140% by weight, relative to the weight of dry base material to be treated, and is preferably between 80 and 120%. In the case where a diluent is used, the weight ratio solvent/diluent is preferably between 90/10 and 70/30.

The granules leaving the rounder are drained and dried. The draining consists essentially in removing the solvent and, if appropriate, the diluent, and is preferably carried out at ambient temperature, whilst the drying consists essentially in removing the water contained in the granules and is preferably carried out in hot air. The granules are then sieved, the granules having the desired particle size are stored and the others are recycled, if appropriate after having undergone grinding under water. A first sieving can advantageously be performed after the first drying and before the treatment in the rounder.

FIG. 1 schematically shows an installation required for carrying out the process according to the invention continuously.

A storage vat 21 contains the base materials which are to be ground in the grinder 23. After grinding, these materials are mixed, in the hopper 24, with the materials coming from the storage vat 22, which do not require prior grinding. The mixture of base materials is transported via a conveyor belt 25 onto a weighing belt 26 and from there into a disintegrator 27, before falling into a granulating tray 11 wetted by a solvent coming from the vat 35.

The granules formed are recovered on a conveyor belt 12 and pass through a sieve 13 before undergoing a first drying in a fluidised bed 14, they are then carried by a conveyor belt 15 into a rounder 16, and, on leaving the rounder 16, the granules are transported by a conveyor belt 17 into a storage hopper 18 before undergoing the final treatments.

FIG. 2 is a diagram showing a complete possible use of the continuous process according to the invention.

The base materials are stored in storage vats 21 and 22. The base materials stored in the vat 21 are ground under water in the grinder 23 before being mixed, in the mixer 24, with the materials coming from the vat 22. The mixture of base materials then undergoes a partial removal of the water, in the drier 26, so as to have a suitable moisture content, and then passes through the disintegrator 27 before being introduced into the granulating tray 11.

The tray 11 is wetted by a liquid coming from a mixing vat 35 supplied from four vats 31, 32, 33 and 34, respectively containing the plasticiser in solution, the solvent, the diluent and the stabiliser in solution. On leaving the granulating tray 11, the granules are sieved on the sieve 13 and undergo a first drying in the fluidised bed 14 before being treated again in the rounder 16. The rounder 16 is supplied with liquid from a mixing vat 36 containing solvent and diluent coming from the vats 32 and 33, and also combustion moderator coming from a vat 37. Graphite, coming from a reservoir 38, is also introduced continuously into the rounder. On leaving the rounder, the granules are drained and then dried in the chamber 41 before being sieved on the sieve 42. The solvents are recovered and recycled into the mixing vat 35. The granules having a correct particle size are stored in a hopper 43, whilst the finest granules are recycled into the mixer 24 and the largest granules are directed into the grinder 23.

The process according to the invention exhibits the following advantages:

it is simple and short and requires much less manpower than a conventional process, it uses tested technologies which require little maintenance, it is safe because, insofar as the base materials are moist, dry powder is not handled until the end of the process, after the final drying. Otherwise, throughout all the operations preceding this drying, the powder contains water, and this considerably limits the risks of ignition, it is economical because it requires little manpower and little complex equipment and because it is very suitable for continuous working and can thus be highly automated and remote-controlled, and, finally, this process is very flexible and permits the use of a wide range of base materials, thus making it possible to obtain fine granular propellant powders of very diverse types, and, in particular, it permits the re-use of downgraded products or recovery products.

The invention also relates, by way of a new industrial product, to the fine propellant powders obtained by virtue of the process according to the invention. In fact, it is one of the surprising aspects of the invention that it makes it possible to obtain grains of propellant powders of good activity without using soluble salt. The grains of powders are obtained at the outlet of the rounder, and it is also surprising to find that the first pass through the granulating tray does not make it possible to obtain a correctly adjusted propellant powder, but that it is only after a first drying and a treatment in the rounder that a product is obtained which possesses the characteristics of a propellant powder which can be used in commercial small-calibre and medium-calibre weapons and mainly in sporting guns.

The ballistic performances of the powders according to the invention depend on the nature of the base materials, and they can be adjusted as follows:

by the composition of the base materials: the higher the potential of these materials, the more active the powder;

by the solvent level used: the lower this level, the more active the powder;

by the particle size: the smaller the diameter of the granules, the more active the powder; a particle size of between 300 and 1,600 microns will preferably be sought;

by the residence time in the granulating tray: the longer this time, the less active the powder; and by the presence of a diluent.

The powders according to the invention can be graded as heterogeneous in the sense that observation of the powders in section under a microscope shows not a homogeneous mass but a slightly porous, heterogeneous mass in which the elements belonging to each of the base materials are recognised individually.

The present invention will be understood more clearly with the aid of the practical examples given below without implying a limitation.

EXAMPLE 1

85% by weight of press-cake having the following composition:

nitrocellulose: 62 parts by weight
nitroglycerine: 38 parts by weight
centralite: 1 part by weight and 15% of finely ground chips of S powder were used as the base material.

The base material has a moisture content of 20% and the solvent used is ethyl acetate, with a wetting level of 98%.

These base materials are granulated in a granulating tray having a diameter of 600 mm and a pan height of 200 mm. The plane of rotation of the tray is inclined by 62° relative to the plane of the horizontal, and the speed of rotation of the tray is 24 rpm. The supply rate to the granulating tray is 6 kg/hour of base material, calculated as dry weight. The granules obtained are dried for 3 hours at ambient temperature and are then treated again in a second granulating tray analogous to the first and under the same conditions of supply rate and speed of rotation.

This gives a powder with a potential of 1,140 cal/g and with a bulk density of 650 kg/m$^3$ for the particle size range between 1,250 and 1,600 microns. This powder is fired in a 12 mm calibre shooting gun under the following conditions:

charge of lead shot: 32 g
powder charge: 1.85 g
felt wad

The firing results are as follows:

initial speed of the lead shot: 370 m/second
maximum pressure in the weapon: 530 bars

EXAMPLE 2

The process is carried out with the equipment of Example 1 and under the same operating conditions, but with the following materials:

100% of press-cake having the following composition:

nitrocellulose: 50 parts
nitroglycerine: 31 parts
dinitrotoluene: 18 parts
centralite: 1 part The operating conditions are as follows:

moisture content: 20%
solvent: ethyl acetate
wetting level: 70%
supply rate: 8 kg/hour This gives a powder having a potential of 988 cal/g and a bulk density of 550 kg/m$^3$ for the particle size range between 800 and 1,250 microns. This powder is fired in a 12 mm calibre sporting gun under the following conditions:

charge of lead shot: 32 g
powder charge: 2 g
felt wad

The firing results are as follows:

initial speed of the lead shot: 394 m/second
maximum pressure in the weapon: 557 bars

EXAMPLE 3

The process is carried out with the equipment of Example 1 and under the same operating conditions, but with the following materials:

60% of press-cake having the following composition:
nitrocellulose: 60 parts
nitroglycerine: 40 parts
10% of ground chips of S powder
30% of ground, single-base nitrocellulose powder.
The operating conditions are as follows:
moisture content: 12%
solvent: isobutyl acetate
diluent: petrol A
ratio solvent/diluent: 70/30
stabiliser: 1% of centralite introduced into the solvent
wetting level: 60%
supply rate: 6.4 kg/hour This gives a powder having a potential of 1,040 cal/g and a bulk density of 680 kg/m$^3$ for the particle size range between 500 and 800 microns. This powder is fired in a 12 mm calibre sporting gun under the following conditions:

charge of lead shot: 32 g
powder charge: 1.65 g
felt wad
The firing results are as follows:
initial speed of the lead shot: 375 m/second
maximum pressure in the weapon: 580 bars

EXAMPLE 4

Press-cake having the following composition:
nitrocellulose: 62 parts
nitroglycerine: 38 parts
centralite: 1 part
is used as the base material.

The moisture content is 20% and the solvent used is butyl acetate.

This press-cake is granulated in a granulating tray having a diameter of 1,200 mm and a pan height of 250 mm. The plane of rotation of the tray is inclined by 57° relative to the plane of the horizontal, and the speed of rotation is 20 rpm. The supply rate is 12 kg/hour of base material, calculated as dry weight, with a wetting level of 72%. The granules are dried for 3 hours at ambient temperature and are then treated again in a second granulating tray under analogous conditions.

This gives a powder having a potential of 1,185 cal/g and a bulk density of 650 kg/m$^3$ for the particle size range between 1,240 and 1,600 microns. This powder is fired in a 12 mm calibre sporting gun under the following conditions:

charge of lead shot: 32 g
powder charge: 2.0 g
felt wad
The firing results are as follows:
initial speed of the lead shot: 395 m/second
maximum pressure in the weapon: 510 bars

EXAMPLE 5

This example shows the influence of an excessively high moisture content in the base materials on the performances of the powder.

Press-cake having the following composition:
nitrocellulose: 67 parts
nitroglycerine: 19.5 parts
dinitrotoluene: 2.5 parts
centralite: 1 part
is granulated in the equipment of Example 1 and under the conditions of Example 1.

The moisture content of the press-cake is 40% and the solvent used is methyl ethyl ketone with a wetting level of 140%.

This gives a powder having a potential of 1,045 cal/g, but the activity of the grains, for the particle size range between 800 and 1,600 microns, is too high for normal use in a sporting weapon. This powder could be suitable for very particular applications, for example for very small charges of lead shot.

We claim:

1. Process for the manufacture of fine granular, completely gelatinized porous propellant powders from at least one solid base material which consists of an energy producing material, wherein said base material is ground to a particle size of less than 300 microns, containing about 20% water, is disintegrated, fed into a rotating apparatus while a solvent for said at least one solid base is sprayed thereon, the solvent being insoluble or little soluble in water, whereby the material is agglomerated and formed into granules, the granules thus obtained are subjected to a first partial drying at room temperature, the product is again shaped in a rotating apparatus, the total wetting level in respect of the solvent is between 60% and 140% with respect to the weight of the dry base material and the granules are dried.

2. Process according to claim 1, wherein said rotating apparatus is a granulating tray.

3. Process according to claim 2, wherein said rounder is a granulating tray.

4. Process according to claim 1, wherein said solvent is a solvent for nitrocellulose.

5. Process according to claim 1 wherein said solvent is selected from the group consisting of methyl ethyl ketone, methyl isobutyl ketone, ethyl acetate, isopropyl acetate, isobutyl acetate and nitromethane.

6. Process according to claim 4, wherein a diluent is added to the said solvent.

7. Process according to claim 6, wherein said diluent is a volatile hydrocarbon.

8. Process according to claim 1, which is a batch process.

9. Process according to claim 1, which is continuous.

10. The process according to claim 2 wherein said granulating tray is kept inclined at an angle of about 57°–62° with the horizontal plane.

11. The process according to claim 1 wherein said solid base material comprises nitrocellulose, recovery powders, waste from the manufacture of double base powders and nitrocellulose/nitroglycerin mixtures.

12. The process according to claim 1 wherein at least a member selected from the group of plasticizers and stabilizers is added to the solvent introduced into the granulating tray.

13. A propellant in the form of granules of ballistic properties adequate for small caliber weapons which consists of a porous, completely gelatinized heterogeneous mass obtained by grinding at least one solid base material which consists of an energy producing material, containing about 20% water, to a particle size of less than 300 microns, disintegrating the ground material, feeding it into a rotating apparatus while a solvent for said at least one solid base material is sprayed thereon, the solvent being insoluble or little soluble in water, whereby the material is agglomerated and formed into granules, the granules thus obtained are subjected to a first partial drying at room temperature, the product is again shaped in a rotating apparatus, the total wetting level in respect of the solvent is between 60% and 140% with respect to the weight of the dry base material, and drying the granules.

14. The process according to claim 1 wherein the product is shaped in a rotating apparatus in the presence of a solvent.

* * * * *